US005239229A

United States Patent [19]

Bouchard

[11] Patent Number: 5,239,229

[45] Date of Patent: Aug. 24, 1993

[54] GLOW DISCHARGE LAMP WITH AUXILIARY ELECTRODE FOR MOUNTING GETTER THEREON

[75] Inventor: Andre C. Bouchard, Peabody, Mass.

[73] Assignee: GTE Products Corporation, Danvers, Mass.

[21] Appl. No.: 796,984

[22] Filed: Nov. 25, 1991

Related U.S. Application Data

[60] Continuation-in-part of Ser. No. 612,774, Nov. 13, 1990, abandoned, which is a division of Ser. No. 463,800, Jan. 8, 1990, Pat. No. 5,017,831, which is a continuation of Ser. No. 139,399, Dec. 30, 1987, abandoned.

[51] Int. Cl.[5] ..... H01J 17/24; H01J 61/26

[52] U.S. Cl. ..... 313/558; 313/549; 313/562

[58] Field of Search ..... 313/549, 553, 558, 562, 313/581, 591, 592, 595, 601, 619

[56] References Cited

U.S. PATENT DOCUMENTS 2,341,990 2/1944 Inmana et al. ..... 313/619
4,117,369 9/1978 Kuus et al. ..... 313/558

*Primary Examiner*—Donald J. Yusko
*Assistant Examiner*—Michael Horabik
*Attorney, Agent, or Firm*—Carlo S. Bessone

[57] ABSTRACT

A glow discharge lamp that includes a light transmitting envelope containing a noble gas fill material and a pair of electrodes disposed in the envelope. Lead-in wires couple to the electrodes and extend to and are hermetically sealed in the envelope. The electrodes include an anode electrode and a cathode electrode. A getter material is disposed on an auxiliary electrode. The getter material is maintained at an elevated temperature by virtue of a continuous lamp discharge to thus maintain chemical pumping in the envelope for the absorption of residual envelope gases.

7 Claims, 1 Drawing Sheet

GLOW DISCHARGE LAMP WITH AUXILIARY ELECTRODE FOR MOUNTING GETTER THEREON

This is a continuation-in-part of copending application Ser. No. 07/612,774 filed Nov. 13, 1990 now abandoned, which is divisional of Ser. No. 07/463,800 filed Jan. 8, 1990 (now U.S. Pat. No. 5,017,831), which is a continuation of application Ser. No. 07/139,399 filed Dec. 30, 1987 (now abandoned).

TECHNICAL FIELD

The present invention relates in general to a compact fluorescent lamp and pertains, more particularly, to a negative glow discharge lamp.

BACKGROUND

A glow lamp typically is comprised of a light transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. Examples of a typical glow discharge lamps are found in U.S. Pat. No. 2,067,129 to Marden; U.S. Pat. No. 3,814,971 to Bhattacharya; and U.S. Pat. No. 4,408,141 to Byszewski, et al.

A standard glow lamp construction is comprised of an envelope that is provided with a phosphor coating on the inner wall of the envelope. The envelope is typically of spherical shape having a generally maximum cross-section bulbous region and also a neck region. There are one or more electron emitting electrodes (cathodes) and one or more electron collecting electrodes (anodes). Typically, a single anode and single cathode are supported in the bulbous region of the envelope. These electrodes may be supported primarily in a side-by-side position.

In the operation of the standard glow lamp, the cathode emits electrons that are accelerated so that mercury vapor is excited in the extended region of the low pressure gas. In this connection the envelope may be filled with a conventional fill material including mercury in a noble gas or a mixture of noble gases. A suitable noble gas is neon or a mixture of neon and argon.

Reference is also now made herein to U.S. Ser. No. 139,397 (now abandoned) which teaches a DC operated negative glow discharge lamp employing a cathode coated with an emissive material and a bare anode. FIG. 1 herein illustrates a glow discharge lamp of this type including an envelope 30 that is provided with a phosphor coating as illustrated at 31. There may be provided one or more electron emitting electrodes (cathodes) and one or more electron collecting electrodes (anodes). FIG. 1, in particular, illustrates a cathode electrode 34 and an anode electrode 36. These electrodes are supported by respective lead-in wires 35 and 37.

In FIG. 1 the envelope 30 is generally of spherical shape having a generally maximum cross-section bulbous region 32 and also including a neck region 33. The lead-in wires 35 and 37 are typically hermetically sealed at the neck region 33 with a wafer item assembly. In FIG. 1, the electrodes 34 and 36 supported primarily in a side-by-side relationship and are approximately at the maximum cross-section bulbous region 32.

In the flow discharge lamp described in U.S. Ser. No. 139,397 (now abandoned), the cathode electrode is coated with an emissive material while the anode electrode is uncoated. The anode electrode is typically bare tungsten coil electrode. The lamp is operated on a DC mode of operation rather than an AC mode of operation. To absorb residual gases which may otherwise be deleterious to life of such lamps, getter substances have been employed in the past.

A getter technique practiced in the prior art is the use of getter strips, typically sold under the trade name Gemedis. These getter strips are disadvantageous because they require complicated activation procedures Moreover, placement of a Gemedis strip about the lamp cathode in the glow lamp results in a marked depreciation in light output due to the absorption of exciting radiation by the strip.

The prior art also describes the use of a tantalum anode specifically in vacuum power triodes and tetrodes for use in radio transmitter applications. The anode in such devices operates at incandescent temperatures at which it getters residual gases, preserving the vacuum integrity of the tube.

DISCLOSURE OF THE INVENTION

One object of the present invention is to provide an improved glow discharge lamp construction having an improved efficacy.

Another object of the present invention is to provide an improved negative glow discharge lamp characterized by an improved lamp getter technique.

A further object of the present invention is to provide an improved glow discharge lamp as in accordance with the preceding object and in which there is no requirement for a complicated technique for activating the getter.

Still another object of the present invention is to provide a method of improving the light output of a gas discharge lamp particularly when operated from a DC power source.

To accomplish the foregoing and other objects, features and advantages of the invention there is provided a glow discharge lamp that is comprised of a light transmitting envelope containing a noble gas fill material and having a bulbous region and a neck region. An auxiliary electrode in the form of a tungsten coil is disposed within the neck region of the envelope remote from the anode and cathode electrodes. The auxiliary electrode has a getter material disposed thereon. Lead-in wires extend through and are hermetically sealed in the envelope and are adapted for coupling a power source to the anode and cathode electrodes for establishing a lamp discharge therebetween and for coupling a heating source to the auxiliary electrode. In accordance with one aspect of the invention, a getter material is applied to the anode electrode. The application of the getter material on the anode electrode is very advantageous because the lamp discharge keeps the getter material on the anode electrode continually at an elevated temperature during lamp operation. Keeping the getter hot during operation is important for good chemical pumping.

In accordance with further features of the present invention, improved lamp operation occurs when the cathode and anode electrodes are simultaneously activated. By connecting both anode and cathode electrode in electrical series, both electrodes are heated simultaneously. In this way any undesired residual gases emitted from the cathode electrode are gettered immediately by the heated anode electrode, thus preventing contaminants from condensing on the phosphor when the lamp is cooled. With reference to further particular features of the invention, the cathode electrode may have an emissive material disposed thereon. This emissive material may comprise a mixture of barium, strontium and calcium carbonates converted to oxides during lamp processing. In addition to the getter material on the anode electrode, a more diluted getter material may also be disposed over the emissive material on the cathode electrode. The preferred getter material is an electropositive metal slurry such as the zirconium slurry described herein and comprised of zirconium dispersed in alcohol.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
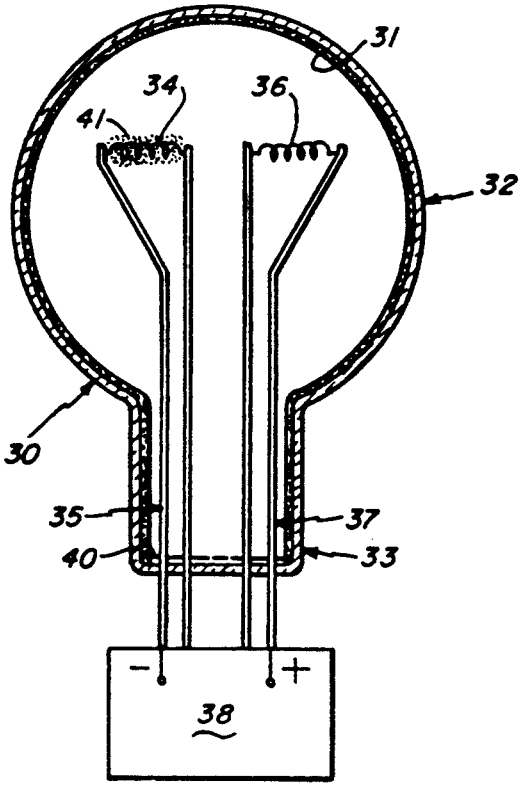
FIG. 1 is a side elevation cross-sectional view of a glow discharge lamp employing a coated cathode electrode and a bare anode electrode operated from a DC power source.

Reference has been made hereinbefore in the background discussion to the glow discharge lamp construction of FIG. 1 as covered in application serial no. 139,397 (now abandoned). This glow discharge lamp comprises a lamp envelope 30 having a bulbous region 32 and a neck region 33. Within the envelope 30 there are provided electrodes 34 and 36 as well as lead-in wires 35 and 37. The lead-in wires 35 support electrode 34 and the lead-in wires 37 support the electrode 36. A phosphor is disposed on the inner surface of the envelope as indicated at 31 in FIG. 1. In this related construction, the anode electrode 36 is devoid of any emissive material while the cathode electrode 34 is coated with an emissive material. The lamp is operated from a DC power source 38.

In the standard glow discharge lamp or the glow discharge lamp of the type described in FIG. 1 herein, we have discovered that an auxiliary electrode may be employed with a getter substance thereon the function of which is to absorb residual gases in the lamp envelope. In this connection, refer to the embodiment in FIG. 2 in which the same reference characters are employed to identify the same parts previously illustrated in connection with the description of FIG. 1. In accordance with the teachings of the present invention, an auxiliary electrode 42 is positioned in the neck region 33 of lamp envelope 30. A getter substance is disposed on auxiliary electrode 42. Auxiliary electrode 42 is supported by a pair of lead-in wires which connect to a separate electrical heating source 38' for activating auxiliary electrode 42 during operation.

Figure 2:
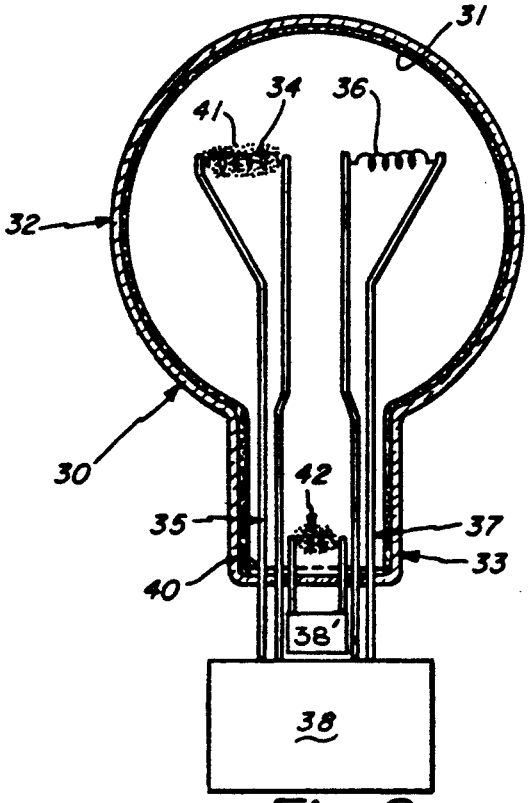
FIG. 2 is a side elevation cross-sectional view of a glow discharge lamp constructed in accordance with the principles of the present invention and employing an auxiliary getter electrode.

Although FIG. 2 depicts anode electrode 36 as a coil supported by a pair of lead-in wires 37, anode electrode 36 may be a refractory metal piece, preferably a molybdenum foil strip supported from an end of a single lead-in wire that is preferably also of molybdenum and swagged to the metal strip.

In accordance with one detailed embodiment of the present invention, the lamp may employ an A-23 incandescent lamp envelope internally coated with a phosphor blend. The electrode mount assembly may be comprised of a multi-pin wafer stem 40 with the attached internal portions of the lead-in wires 35 and 37 and the lead-in wires of auxiliary electrode 42 made of, for example, 0.02" diameter nickel. The portions of the lead-in wires which are imbedded in the glass of the stem are composed of a composite material or alloy having a thermal expansion coefficient matching that of the glass. The electrodes 34 and 36 along with auxiliary electrode 42 are clamped on the end of each pair of lead-in wires. Each of the electrodes may be a #41 triple coiled tungsten exciter. Auxiliary electrode 42 is coated, in accordance with the present invention, with the getter material to be described below. This getter material is illustrated in FIG. 3 at 63.

In accordance with a second embodiment of the present invention, there is provided another technique for introducing a lamp getter into a glow discharge lamp without requiring an auxiliary electrode.

Figure 3:
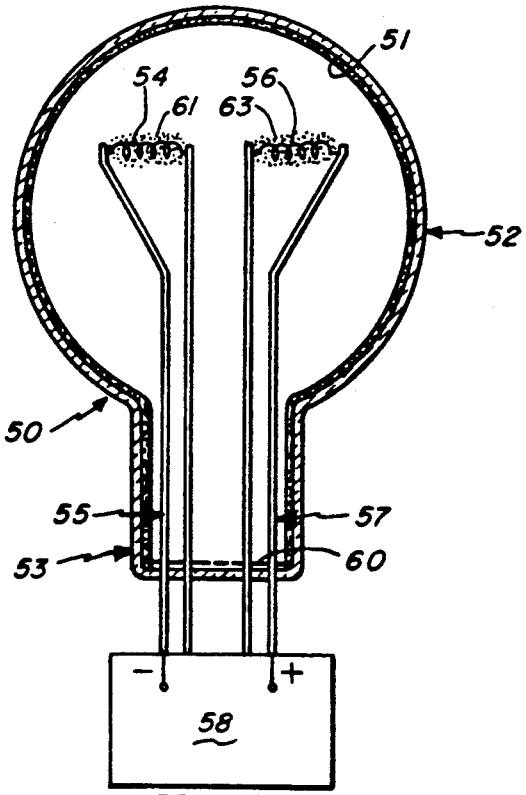
FIG. 3 is a side elevation cross-sectional view of another embodiment of a glow discharge lamp constructed in accordance with the principles of the present invention.
Figure 4:
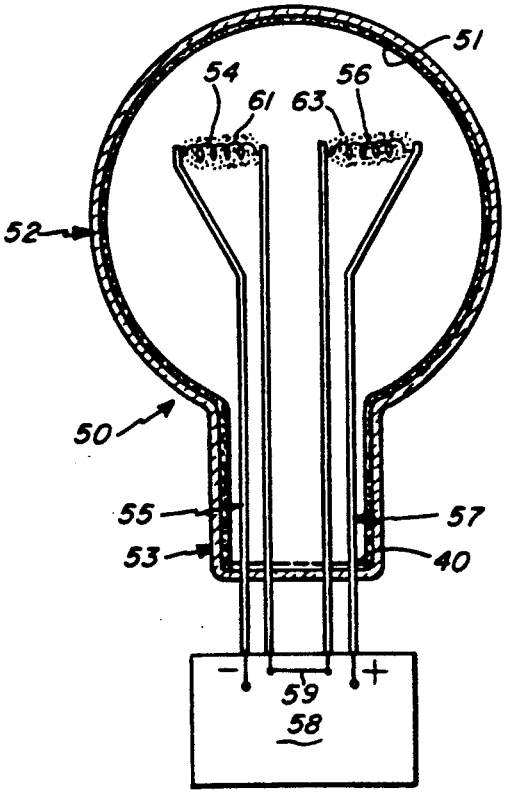
FIG. 4 is a side elevation cross-sectional view of a glow discharge lamp also constructed in accordance with the present invention and illustrating the series connection of the anode and cathode electrodes during lamp cathode activation.

More specifically, a suitable getter material is applied on substantially the entire length of the anode electrode of a DC operated glow lamp as depicted in FIGS. 3 and 4 herein. The application of the getter matter on the anode electrode is preferred, because the lamp discharge keeps the getter material on the anode electrode continually at an elevated temperature during lamp operation. Keeping the getter hot during operation is important for good chemical pumping within the envelope.

Reference is now made to the lamp construction of FIG. 3. FIG. 3 illustrates a glow discharge lamp that is comprised of a lamp envelope 50 that has a bulbous region 52 and a neck region 53. Within the envelope 50 there are provided electrodes 54 and 56. Lead-in wires 55 support the electrode 54 and lead-in wires 57 support the electrode 56. A phosphor is disposed on the inner surface of the envelope as illustrated at 51 in FIG.3. The lamp is operated from a DC power source 58.

In accordance with a second detailed embodiment of the present invention, the lamp may employ an A-23 incandescent lamp envelope internally coated with a phosphor blend. The electrode mount assembly may be comprised of a multi-pin wafer stem 60 with the attached internal portions of the lead-in wires 55 and 57 made of, for example, 0.02" diameter nickel. The portions of the lead-in wires which are imbedded in the glass of the stem are composed of a composite material or alloy having a thermal expansion coefficient matching that of the glass. The electrodes 54 and 56 are clamped on the end of each pair of lead-in wires. Each of the electrodes may be a #41 triple coiled tungsten exciter.

In the lamp illustrated in FIG. 3, the electrode 54 is the cathode electrode and the electrode 56 is the anode electrode. The cathode electrode 54 is coated with an emissive coating illustrated in FIG. 3 at 61. This coating may be a standard mix such as a mixture of barium, strontium and calcium carbonates that are converted to oxides during lamp processing. As indicated the coated electrode is the electrode 54 in the FIG. 3 and this electrode serves as the lamp cathode. The other electrode 56 is left free of any coating and is thus referred to as a bare tungsten electrode, but has applied thereto, in accordance with the present invention, the getter material now to be described. This getter material is illustrated in FIG. 3 at 63.

The getter material 42 in FIG.2 and 63 in FIGS. 3 and 4 is preferably an electropositive metal slurry such as a zirconium slurry. This is applied to the bare tungsten electrode such as with the use of a small "dabber". The zirconium slurry is composed of 100% zirconium dispersed in alcohol. The lamp is processed in a normal fashion with activation of the anode and cathode electrodes performed at the same time. An alternative element to zirconium is titanium or hafnium.

In constructing one lamp in accordance with the present invention the envelope is evacuated of air and heated to approximately 400° C. The electrodes are activated in a vacuum by heating to approximately 1250° C. The lamp is filled with a 3 torr mixture of neon and argon. This mixture may comprise 99.5% neon and 0.5% argon along with a drop of mercury, approximately 30 milligrams in weight. This is added before lamp tipoff.

Another feature of the present invention is illustrated in FIG. 4. In FIG. 4 like reference characters are used to identify like parts as previously referenced in FIG. 3. Thus, in FIG. 4 there is described a lamp that is comprised of a lamp envelope 50 that has a bulbous region 52 and a neck region 53. Within the envelope 50 there are provide electrodes 54 and 56.

Lead-in wires 55 support the electrode 54 and lead-in wires 57 support the electrode 56. A phosphor is disposed on the inner surface of the envelope as indicated at 51 in FIG. 4. The aforementioned coatings are applied at 61 and 63 to the respective electrodes 54 and 56, respectively. However, in the embodiment of FIG. 4 there is described an arrangement in which the cathode and anode electrodes are activated simultaneously. By connecting both anode and cathode electrodes in electrical series as illustrated by the connection 59 in FIG. 4, both electrodes, with their predisposed coatings, are heated simultaneously. This is advantageous in that any water vapor, carbon dioxide, or other gaseous species emitted from the cathode electrode during activation are gettered immediately by the heated anode that is preferably coated with zirconium. This precludes the contaminants from condensing on the phosphor when the lamp is cooled.

An indication of the effectiveness of the gettering action of the positioned getter in the glow lamp is evident from out gas data taken after lamps with and without getter were operated for several days. The out gas data obtained were as follows:

| | $H_2$ % | $H_2O$ % | CH % | N/CO % | CO % | Ar % | Ne % |
|---|---|---|---|---|---|---|---|
| Control Lamp | .094 | .047 | .004 | .053 | .004 | .5 | 99.3 |
| Getter Lamp | .053 | .000 | .005 | .000 | .005 | .0 | 99.4 |

Clearly there is less $H_2$, $H_2O$, N/CO in the getter lamp. $H_2O$ and CO are particularly deleterious to cathode performance, while $H_2$ is damaging to the phosphor. Indications of the cleanliness of the lamp are borne out also from zero field thermionic emission measurements made at 800° C. cathode temperature for both the gettered lamp and control lamp. Results were as follows:

| | I° (A) | T° C. |
|---|---|---|
| Control | .2-.5 | 800° C. |
| Getter | 1.0-1.2 | 800° C. |

The higher zero field thermionic emission value obtained results in glow lamp efficacy approximately 3.5 LPW higher for the getter lamp than the control lamp.

In an alternate embodiment of the present invention the getter material may be placed on a molybdenum foil anode configuration such as of the type described in U.S. Ser. No. 139,398 (now abandoned) that describes a glow discharge lamp having an anode electrode of a refractory metal piece, preferably a molybdenum foil strip supported from an end of a single lead-in wire that is preferably also of molybdenum and swagged to the metal strip. The getter material described herein may be applied to the molybdenum foil strip by being dabbed thereon. The getter is activated during the initial lightup when the foil reaches incandescent temperatures.

Lamps described above and constructed with a molybdenum foil anode coated with getter material have exceeded 12,000 hours of continuous burning. In comparison, similar lamps constructed with a molybdenum foil anode but without the getter material coating generally do not exceed 5000 hours of continuous burning.

In accordance with still another embodiment of the present invention, in addition to applying the getter material to the anode electrode, it may also be applied to the cathode electrode. In such an arrangement the getter is in a very diluted form and is disposed over the cathode electrode for the purpose of providing additional gettering. The getter coating applied to the cathode has to be appreciably thinner than that applied to the anode to assure that there is no change in the emissive property of the cathode electrode.

In summary, the present invention describes an improved technique for improving the efficacy of negative glow discharge lamps with the use of a getter on the anode electrode. In this way the getter material is self-heating and there is no requirement for any auxiliary electrode or auxiliary lead wires for support of the getter material. It is furthermore noted that the anode and cathode electrodes have substantially the same area. In this regard it was surprising to find that the relatively small getter surface employed in accordance with the present invention actually provide an extremely effective surface of sorbing the contaminants so as to increase the cathode thermionic emission. This is believed to have occurred by virtue of the preferred construction of simultaneous activation of the getter and anode so as to prevent active gases evolved from the cathode from sorbing on the phosphor coating. In this connection it is noted that the gaseous discharge in accordance with the negative glow discharge lamp construction serves to convert many of the contaminating species to negative ions which are attracted to the anode and thus are immediately gettered thereat. This occurs because these deleterious contaminants are generally electronegative species which readily capture electrons to form stable negative ions. They are contained in the interelectrode space in a plasma containing a high density (as many as a few times $10^{12}/cm^3$) of free electrons, providing ample opportunity for negative ion formation. These negatively-ionized contaminants are urged in the same direction as the free electrons (toward the anode and away from the cathode) by the potential difference between the positive anode and negative cathode. Having reached the anode, the electronegative contaminants are brought into intimate contact with the electropositive getter substance disposed thereon, facilitating rapid chemical reactions to remove the contaminants from the gas phase. It is believed that the improved operation is due at least in significant part to the simultaneous activation of the getter and cathode electrode as well as the realization of the fact that many of the contaminating species are converted in the plasma to negative ions.

While there have been shown and described what are at present considered the preferred embodiments of the invention, it will be obvious to those skilled in the art that various changes and modifications may be made therein without departing from the scope of the invention as defined by the appended claims.

What is claimed is:

1. A DC-operable glow discharge lamp comprising:

a light transmitting envelope containing a noble gas fill material and having a bulbous region and a neck region;

a pair of electrodes disposed within said bulbous region of said envelope and comprising an anode electrode and a cathode electrode;

an auxiliary electrode being in the form of a tungsten coil disposed within said neck region of said envelope remote from said anode and cathode electrodes, said auxiliary electrode having a getter material disposed thereon; and lead-in wires extending through and hermetically sealed within said envelope for coupling a power source to said anode and cathode electrodes so as to establish a lamp discharge therebetween and for coupling a heating source to said auxiliary electrode.

2. The glow discharge lamp as set forth in claim 1 wherein said envelope also contains mercury and emits ultraviolet radiation upon excitation.

3. The glow discharge lamp as set forth in claim 2 including a phosphor coating on an inner surface of said envelope and which emits visible light upon absorption of ultraviolet radiation.

4. A glow discharge lamp as set forth in claim 1 wherein the getter material comprises an electropositive metal slurry.

5. A glow discharge lamp as set forth in claim 4 wherein said slurry is a zirconium slurry.

6. A glow discharge lamp as set forth in claim 5 wherein the slurry comprises zirconium dispersed in alcohol.

7. A glow discharge lamp as set forth in claim 1 wherein said getter material is selected from the group comprising zirconium, titanium and hafnium.

* * * * *